US006394097B1

(12) United States Patent
Okumoto

(10) Patent No.: US 6,394,097 B1
(45) Date of Patent: May 28, 2002

(54) DEVICE AND METHOD FOR INSPECTING FILTER ROD FOR CIGARETTE

(75) Inventor: Yutaka Okumoto, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 0 days.

(21) Appl. No.: 09/486,559

(22) PCT Filed: Jun. 29, 1999

(86) PCT No.: PCT/JP99/03497

§ 371 (c)(1),
(2), (4) Date: Feb. 29, 2000

(87) PCT Pub. No.: WO00/00046

PCT Pub. Date: Jan. 6, 2000

(30) Foreign Application Priority Data

Jun. 30, 1998 (JP) ..... 10-184547

(51) Int. Cl.[7] ..... A24C 5/32

(52) U.S. Cl. ..... 131/280; 131/281; 131/905; 131/906; 131/907; 209/535; 209/536; 250/223; 198/372; 198/438; 53/148

(58) Field of Search ..... 131/280, 905, 131/906, 907, 281; 209/535, 536; 250/223; 198/372, 438; 53/148

(56) References Cited

U.S. PATENT DOCUMENTS 4,277,678 A 7/1981 Wahle et al.

FOREIGN PATENT DOCUMENTS

| | | | | |
|---|---|---|---|---|
| JP | A 55-42596 | | 3/1980 | |
| JP | A 2-25705 | | 1/1990 | |
| JP | 2-25705 A | * | 1/1990 | ..... G01B/11/10 |
| JP | A 9-9948 | | 1/1997 | |

* cited by examiner

*Primary Examiner*—Stanley S. Silverman
*Assistant Examiner*—Mark Halpern
(74) *Attorney, Agent, or Firm*—Birch, Stewart, Kolasch & Birch, LLP

(57) ABSTRACT

A device for executing an inspection method of a filter rod for cigarettes includes an inspection drum (6), and the inspection drum (6) has plural pickup grooves (8) for receiving one filter rod (F) each in its outer periphery. The filter rod (F) in each pickup groove (8) is provided with rolling force by a rolling guide (10), and passes through an illuminated region (B) of light while the inspection drum (6) rotates. At this time, when the filter rod (F) rolls, the shielded portion of the illuminated region (B) due to the filter rod (F) varies. This variation means that the filter rod (F) is normal, and is hence used for determination of the inspection.

8 Claims, 5 Drawing Sheets

DEVICE AND METHOD FOR INSPECTING FILTER ROD FOR CIGARETTE

This application is the national phase under 35 U.S.C. §371 of PCT International Application No. PCT/JP99/03497 which has an International filing date of Jun. 29, 1999, which designated the United States of America.

TECHNICAL FIELD

The present invention relates to a device and a method of inspection of appearance of a filter rod used in manufacture of filter-tipped cigarettes.

BACKGROUND ART

A filter rod of this type includes a filter material made of a bunch of acetate fibers, and a sheet of paper for wrapping the filter material. The diameter of the filter rod is about 8 mm, and its length is in a range of 80 to 120 mm.

Such filter rod is first manufactured by a rod manufacturing machine, and supplied from the rod manufacturing machine into a filter feeder, then sent out from the filter feeder toward a filter-tipped cigarette manufacturing machine or a filter attachment with air stream in an air tube.

As known well, in the filter attachment, the filter rod is cut into four to six filter plugs, and each plug and two cigarettes are mutually combined by a tip paper piece, and a double filter-tipped cigarette is manufactured. Later, the double filter-tipped cigarette is cut off from the center of the plug, and individual filter-tipped cigarettes are obtained.

Since the filter rod is soft, the appearance of the filter rod is likely to have abnormality. Such appearance abnormality includes a bend of the filter rod, crush on the outer periphery of the filter rod, deformation of an end of the filter rod, a tear of the seam of the paper, etc.

Such appearance abnormality of the filter rod may further lead to a clogging of the filter rod in the filter feeder, the air tube or the filter attachment, or breakage of the filter rod and defective connection between the cigarettes and the plug in the filter attachment. The clogging of the filter rod may cause a shutdown of operation of the entire system from the filter feeder to the filter attachment, and the operation rate of the system is lowered. Such cutting and defective connection increase the number of defective filter-tipped cigarettes, and the productivity of filter-tipped cigarettes is lowered.

Accordingly, the defective filter rod having appearance abnormality should be eliminated from the system, and the appearance abnormality of the filter rod, therefore, must be inspected. However, since the filter rod are sent out at high speed from the filter feeder toward the filter attachment, it is not easy to develop a device and a method for inspecting the filter rods, individually.

SUMMARY OF THE INVENTION

It is hence an object of the present invention to provide an inspection device and an inspection method capable of inspecting appearance abnormality of a filter rod securely according to a simple principle of inspection.

The above object is achieved by the present invention. According to an inspection device and an inspection method of the present invention, a filter rod is fed along a conveying path, and contacted with a rolling surface in the conveying process so that a rolling force is applied to the filter rod. Thereafter, the inspection device and inspection method detect if the filter rod rolls on the rolling surface or not, and then determinate whether the filter rod is defective or not on the basis of the detection result.

In the case of a normal filter rod having no abnormality in appearance, when a rolling force is applied, the normal filter rod rolls easily. In the case of a defective filter rod having abnormality in appearance, even if a rolling force is applied, the defective filter rod does not roll. Accordingly, by detecting if the filter rod rolls or not in the conveying process of the filter rod, it is possible to determinate if the filter rod is defective or not. If the filter rod is defective, such defective filter rod is excluded from the conveying path.

For feeding filter rods, a rotatable inspection drum may be used. The inspection drum has a groove in the outer periphery thereof, the groove receiving one filter rod. The groove feeds the received filter rod while the inspection drum rotates. Further, the groove of the inspection drum has enough size for allowing rolling of the filter rod therein if the received filter rod is normal.

In this case, the aforesaid rolling surface may be defined at an inner surface of a rolling guide. The rolling guide extends along the outer periphery of the inspection drum, and partially covers the outer periphery. When the filter rod in the groove is fed while the inspection drum rotates, the filter rod receives a centrifugal force, and is pushed out toward the inner surface of the rolling guide. As a result, the filter rod contacts with the inner surface of the rolling guide, and securely receives the rolling force produced by the contact.

The inspection drum may be a grooved drum in the filter feeder or the filter attachment. More specifically, the inspection drum is preferred to serve also as a pickup drum for picking up filter rods one by one from a hopper in the filter feeder or the filter attachment. In this case, the inspection device can be easily assembled into the filter feeder or the filter attachment.

Rolling of the filter rod on the rolling surface can be detected by optically measuring a diameter of the filter rod. More specifically, means for measuring the diameter of the filter rod comprises a light emitter for emitting light toward the rolling surface and forming an illuminated region of light, the illuminated region being able to completely cover the filter rod with respect to the feeding direction of the filter rod, and a photo detector for measuring a shielded portion in the illuminated region by the filter rod while the filter rod is completely covered within the illuminated region of light and continuously outputting a measurement signal.

In this case, means for determining if the filter rod is rolling or not decides that the filter rod is normal when a ripple is contained in the measurement signal from the photo detector. This principle of the decision is based on the fact that a cross section of the filter rod, if normal, is not a complete round. That is, if the filter rod is rolling, the measurement signal indicating the diameter of the filter rod is not constant, but varies due to rolling of the filter rod, whereas if the filter rod is not rolling, the measurement signal is constant.

BEST MODE FOR CARRYING OUT THE INVENTION

Figure 1:
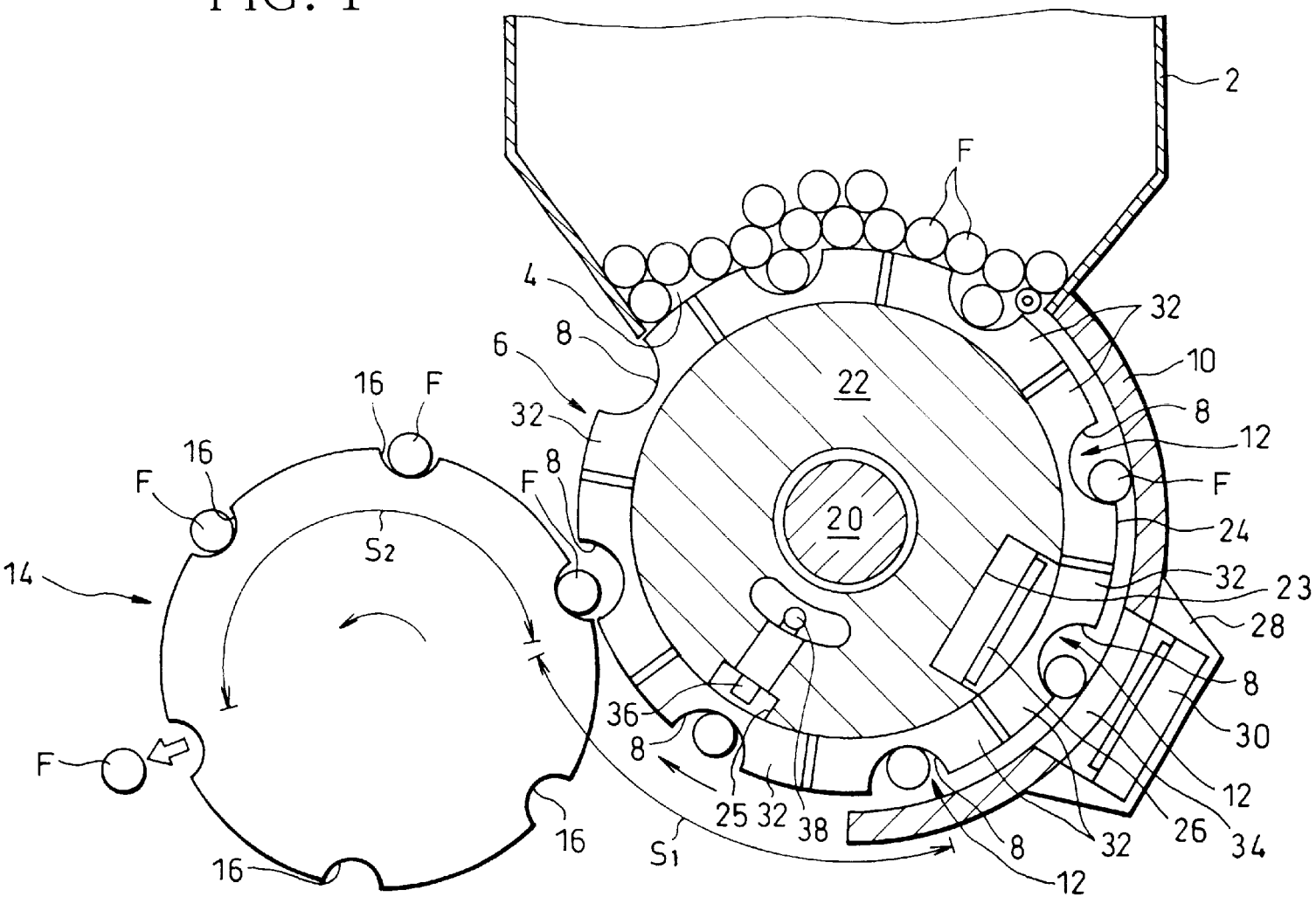
FIG. 1 is a sectional view of an inspection device in an embodiment of the present invention.

An inspection device in FIG. 1 has a hopper 2, and the hopper 2 has a plurality of filter rods F. The hopper 2 is also used as a hopper for the filter feeder or the filter attachment mentioned above. When the hopper 2 is used for the filter feeder, the hopper 2 receives filter rods F manufactured in a rod-manufacturing machine. On the other hand, when the hopper 2 is used for the filter attachment, the hopper 2 receives the filter rods F supplied from the filter feeder through an air tube.

The hopper 2 has an outlet 4 at a lower end thereof, and the outlet 4 is closed by an inspection drum 6. The inspection drum 6 is rotatably disposed underneath the outlet 4, and a part of an outer periphery of the drum forms a bottom wall of the outlet 4. The inspection drum 6 has plural pickup grooves 8 on the outer periphery thereof, and these pickup grooves are disposed at equal intervals in a circumferential direction of the inspection drum 6. Each of the pickup grooves 8 is large enough to receive one filter rod F. More specifically, the pickup groove 8 has an arc-shaped cross section, and its width is sufficiently wider than a diameter of the filter rod F, and its depth is nearly equal to the diameter of the filter rod F.

When the inspection drum 6 is rotated in the clockwise direction as indicated by arrow in FIG. 1, each of the pickup grooves 8 of the inspection drum 6 sequentially enters into the outlet 4 of the hopper 2, and receives one filter rod F in the hopper 2. As the inspection drum 6 is further rotated, the filter rod F in the pickup groove 8 is taken out of the hopper 2, and fed along the outer circumference of the inspection drum 6. That is, the inspection drum 6 defines a conveying path for the filter rods F.

The outer periphery of the inspection drum 6 is partially covered by a rolling guide 10 of an arc shape. The rolling guide 10 extends from the outlet 4 of the hopper 2 in the rotating direction of the inspection drum 6 along the outer periphery of the inspection drum 6. That is, in FIG. 1, the rolling guide 10 covers the right half of the outer periphery of the inspection drum 6. The rolling guide 10 cooperates with the inspection drum 6 to define an arc-shaped space 12. The width of the rolling space 12 (that is, the spacing between the outer periphery of the inspection drum 6 and an inner surface of the rolling guide 10) in FIG. 1 is narrower than the diameter of the filter rod F, and is constant in the circumferential direction of the drum 2.

As far as the filter rod F is normal, the rolling space 12 allows the filter rod F in the pickup groove 8 to rotate about the axis of the rod F. More specifically, when the filter rod F in the pickup groove 8 is taken out form the outlet 4 of the hopper 2, and the filter rod F receives centrifugal force and gravity, and is pushed toward the outer side in a radial direction of the inspection drum 6, and contacts with the inner surface of the rolling guide 10. Herein, since the width of the rolling space 12 is narrower than the diameter of the filter rod F, the filter rod F cannot completely slip out of the pickup groove 8.

The contact of the filter rod F with the rolling guide 10 generates frictional force between the filter rod F and rolling guide 10, and the frictional force causes the filter rod F to roll on the inner surface of the rolling guide 10. That is, the frictional force provides the filter rod F with a rolling force. Accordingly, if the filter rod F is normal without any abnormality in appearance, that is, if the filter rod F is straight and its outer periphery is smooth, the filter rod F in the pickup groove 8 is fed while rolling on the inner surface of the rolling guide 10. In other words, the inner surface of the rolling guide 10 is formed as a rolling surface for guiding and rolling the filter rod F. At this time, when the rotating speed of the inspection drum 6 is sufficiently higher than the falling speed of the filter rod F, the filter rod F in the pickup groove 8 rolls on the inner surface of the rolling guide 10 while being pushed out by a rear opening edge of the pickup groove 8.

However, if the filter rod F is defective having abnormality in appearance, that is, if the filter rod F is bent, twisted, broken, or deformed three-dimensionally, or if the filter rod F is crushed, torn in the seam, and not in a nearly perfect circular form, the filter rod F is caught in a groove wall of the pickup groove 8 or the inner surface of the rolling guide 10, and rolling of filter rod F in the pickup groove 8 is prevented.

Figure 2:
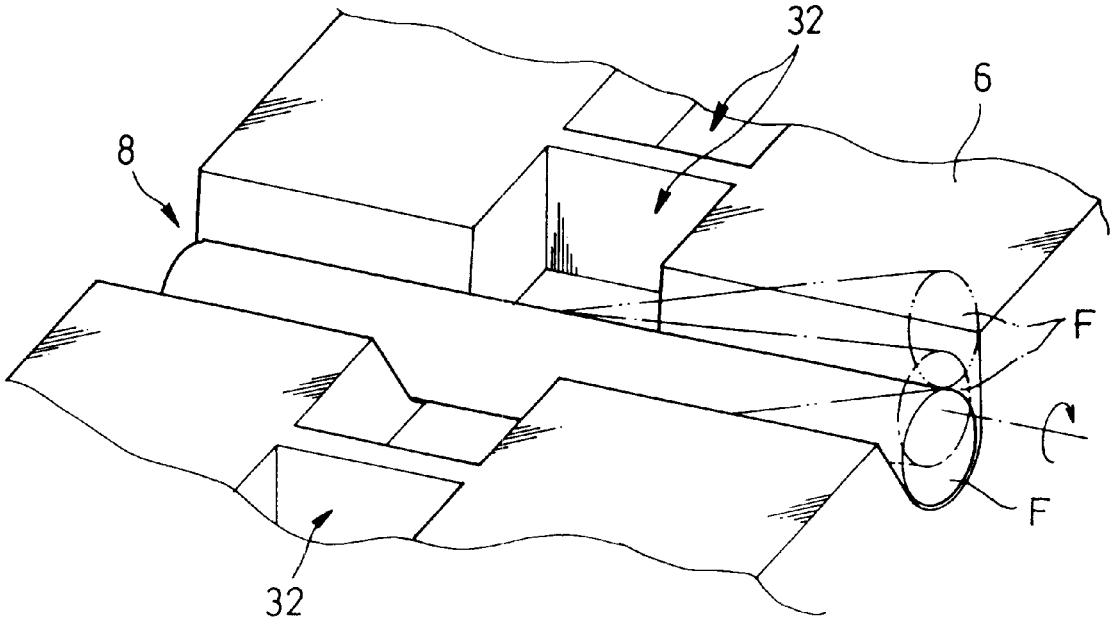
FIG. 2 is a magnified perspective view of a pickup groove in FIG. 1.
Figure 3:
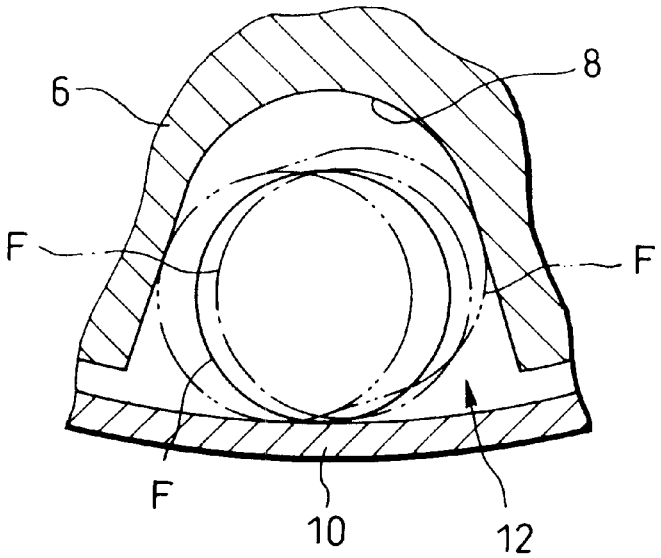
FIG. 3 is a cross sectional view of the pickup groove in FIG. 2.

More specifically, a normal filter rod F is straight as shown by solid line in FIGS. 2 and 3, and its cross section is a nearly perfect circular form in the overall length. Therefore the filter rod F contacts with the inner surface of the rolling guide 10 securely almost in the overall length, and the rod F can roll smoothly about the axis thereof while contacting with the inner surface of the rolling guide 10. In the case of a defective filter rod F as indicated by two-dot chain line in FIGS. 2 and 3, since the filter rod F has deformation owing to bending, twisting or breaking, a part of the rod F merely contacts with the inner surface of the rolling guide 10. Accordingly, rolling of the defective filter rod F is substantially prevented by the inner surface of the rolling guide 10 or the groove walls of the pickup groove 8. Or even if the defective filter rod F can roll in the pickup groove 8, its rolling is not rotation about the axis of the filter rod F on the inner surface of the rolling guide 10, but is a meandering rolling motion.

Herein, the normal filter rod F may not be always perfectly straight, but a slight deformation of appearance is permitted. More specifically, deformation of the filter rod F is allowed as far as no problem is caused in feeding, cutting or other processing of the filter rod F in the filter feeder, the air tube extending from the filter feeder to the filter attachment, or inside of the filter attachment. In FIGS. 2 and 3, for example, in the case of filter rod F indicated by one-dot chain line, if bending, twisting or breaking of the filter rod F is slight, and rolling of the filter rod F in the pickup groove 8 is allowed, this filter rod F is regarded to be normal.

Incidentally, even if the outer periphery of the filter rod F is pressed and crushed in part or in whole, and the sectional shape of the filter rod F is not a complete round, as far as smooth rolling of the filter rod F is allowed, such filter rod F is regarded to be normal.

When the filter rod 6 reaches a terminal end of the rolling guide 10 while the inspection drum 6 rotates, the filter rod F is sucked by suction means to the bottom of the pickup groove 8. Therefore, if the filter rod F passes through the rolling guide 10, the filter rod F does not drop out from the pickup groove 8, and filter rod F is fed continuously.

As shown in FIG. 1, the inspection device has a grooved drum 14 at the left side of the inspection drum 6, and the drum 14 is disposed adjacently to the inspection drum 6. The drum 14 has conveying grooves 16 formed at equal intervals on an outer periphery thereof. The pitch of these conveying grooves 16 is same as the pitch of the pickup grooves 8. The drum 14 is rotated in the counterclockwise direction at the same peripheral speed as that of the inspection drum 6. Therefore, while the drums 6 and 14 rotate, the pickup grooves 8 and conveying grooves 16 sequentially meet each other, individually.

Figure 4:
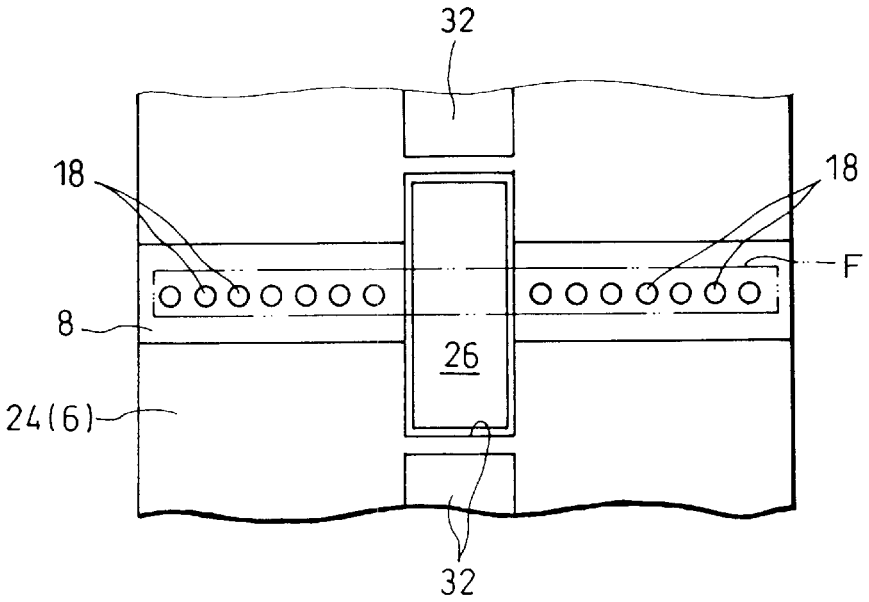
FIG. 4 is a diagram showing a bottom of the pickup groove in FIG. 2.

As shown in FIG. 4, each of pickup grooves 8 of the inspection drum 6 has plural suction holes 18 in the bottom thereof, and these suction holes 18 are distributed in one row at specific intervals in the axial direction of the pickup groove 8. When each of pickup grooves 8 moves within a suction region which extends from the terminal end of the rolling guide 10 to a position immediately before the drum 14 while the inspection drum 6 rotates, the suction holes 18 of the pickup groove 8 are supplied with suction pressure, and suck and hold the filter rod F at the bottom of the pickup groove 8. More specifically, the suction region is indicated by reference numeral $S_1$ in FIG. 1, and is defined by the suction chamber (not shown) in the inspection drum 6.

Such suction chamber is more specifically described below. As shown in FIG. 1, the inspection drum 6 has its central drive shaft 20, and the drive shaft 20 is enclosed by a fixing sleeve 22. A specified gap is secured between the drive shaft 20 and the fixing sleeve 22. An outer periphery of the fixing sleeve 22 is surrounded by a drum shell 24, and the drum shell 24 rotates integrally with the drive shaft 20. The pickup grooves 8 and suction grooves 18 are formed on the drum shell 24, and the suction chamber is defined in the fixing sleeve 22 as a groove, the groove extending in the suction region $S_1$. This groove is always connected to a negative pressure source (not shown) through inside of the fixing sleeve 22.

Plural suction holes (not shown) are formed on the bottom of each conveying groove 16, and the drum 14 has a suction region $S_2$ as shown in FIG. 1. The suction region $S_2$ extends from the meeting position, where one of the conveying grooves 14 meets one of pickup grooves 8, in the rotating direction of the drum 14 as seen in the circumferential direction of the drum 14. Therefore, when ones of the pickup grooves 8 and conveying grooves 16 of the drums 6 and 14 meet each other, the filter rod F in the one of the pickup grooves 8 is sucked and received in the one of conveying grooves 16. That is, the filter rod F is transferred from the drum 6 to the drum 14, and is fed by rotation of the drum 14. Consequently, the filter rod F is supplied from the drum 14 in a conveying path in the filter feeder or the filter attachment, that is, in a train of grooved drums, and is fed on the train. In this conveying course, the filter rod F is handled according to required processes.

As shown in FIG. 1, the fixing sleeve 22 has a fitting hole 23 on the outer periphery thereof. The fitting hole 23 accommodates a floodlight 26. The flood light 26 is covered with the rolling guide 10, and is disposed below a horizontal plane including the axis of the inspection drum 6. The floodlight 26 emits light toward the outside of the inspection drum 6, that is, the inner surface of the rolling guide 10. More specifically, the floodlight 26 includes an array of light emitting diodes, and this array is connected electrically to a current feeding circuit (not shown).

On the other hand, the rolling guide 10 has a light receiver 30 at its outer side. The light receiver 30 is fixed to the rolling guide 10 through a holder 28, and is disposed at a position confronting the floodlight 26. The light receiver 30 includes, for example, an array of photo diodes, and this array is electrically connected to a detecting/determining circuit described below.

As clear from FIGS. 1 and 4, the drum shell 24 has light guide holes 32 in individual pickup grooves 8. These light guide holes 32 extend in the circumferential direction of the inspection drum 6 crossing the center of the corresponding pickup groove 8, respectively and penetrate through the drum shell 24. Further, each of the guide holes 23 is at the same position as the floodlight 26 and light receiver 30 with respect to the axial direction of the inspection drum 6. Therefore, each light guide hole 32 passes through between the floodlight 26 and light receiver 30 while the inspection drum 6 rotates.

The rolling guide 10 has an opening 34, and the opening 34 is disposed between the floodlight 26 and the light receiver 30. Therefore, when the pickup groove 8 passes through the floodlight 26, the light emitted from the floodlight 26 is led into the light receiver 30 through the light guide hole 32 and opening 34.

As seen in the circumferential direction of the inspection drum 6, herein, an illuminated region of the light emitted from the floodlight 26 is sufficiently wider than the diameter of the filter rod F. Accordingly, when the filter rod F in the pickup groove 8 passes through the floodlight 26 while the inspection drum 6 rotates, the illuminated region of light can completely cover the filter rod F, and the filter rod F can roll within the illuminated region of light.

The fixed sleeve 22 further has a fitting hole 25 on the outer periphery thereof. The fitting hole 25 accommodates a rejection nozzle 36. The rejection nozzle 36 is disposed at the downstream side of the rolling guide 10 as seen in the rotating direction of the inspection drum 6, that is, between the rolling guide 10 and drum 14. The rejection nozzle 36 is provided at a position corresponding to the moving trajectory of the light guide holes 32, and has a nozzle opening facing onto the outside of the inspection drum 6. The rejection nozzle 36 includes a solenoid valve for opening and closing the nozzle opening, and is connected to a tube 38 through the solenoid valve. The tube 38 extends in the fixing sleeve 22, and is connected to a compression air source (not shown).

Figure 5:
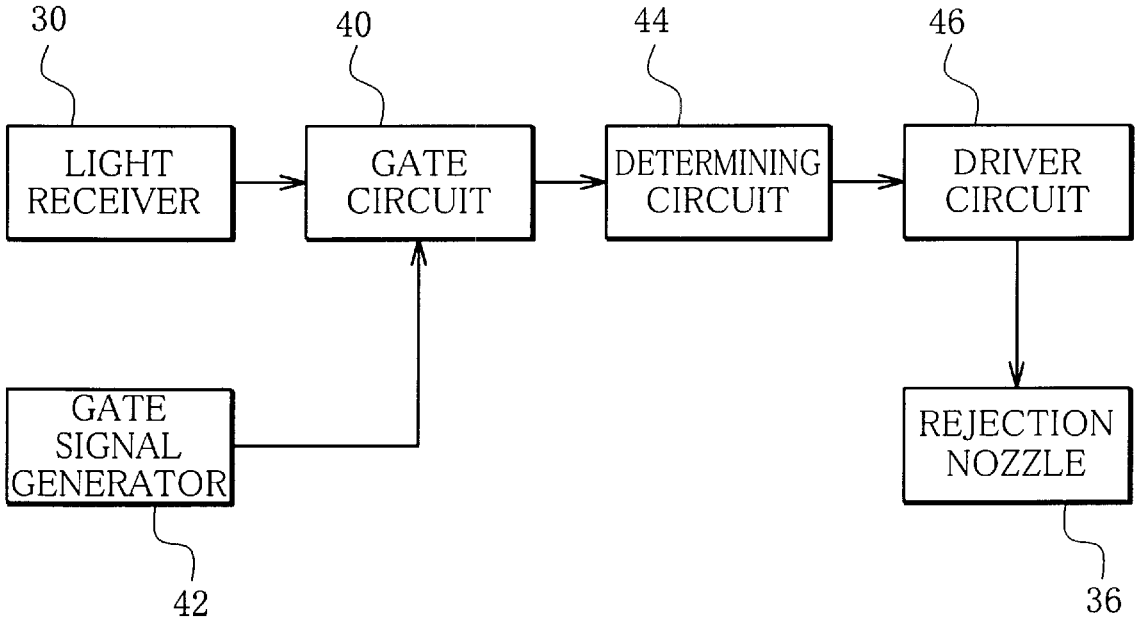
FIG. 5 is a block diagram showing a detecting/determining circuit.

FIG. 5 shows the detecting/determining circuit, and the detecting/determining circuit has a gate circuit 40. The gate circuit 40 is electrically connected to the light receiver 30, and receives the output from the light receiver 30. The gate circuit 40 is electrically connected to a gate signal generator 42. The gate signal generator 42 supplies a pulse signal to the gate circuit 40. Herein, the gate signal generator 42 continues to output the gate signal while the pickup groove 8 of the inspection drum 6 moves within a predetermined rotational angle region of the inspection drum 6, that is, in a period while the filter rod F in the pickup groove 8 is completely covered or entered in the illuminated region of the light from the floodlight 26.

The gate circuit 40, while receiving the gate signal from the gate signal generator 40, passes the output from the light receiver 30, and supplies to a determining circuit 44. The determining circuit 44 determines if the filter rod F is normal or not depending on the output of the light receiver 30. The determining circuit 44 is electrically connected to the solenoid valve of the rejection nozzle 36 through a driver circuit 46. Suppose the filter rod F is determined to be defective by the determining circuit 44, the determining circuit 44 opens the solenoid valve of the rejection nozzle 36 through the driver circuit 46 timely, and therefore the rejection nozzle 36 injects compressed air for a predetermined period.

A method of inspection of the filter rod F executed in the detecting/determining circuit is specifically explained below together with the principle of its inspection.

Figure 6:
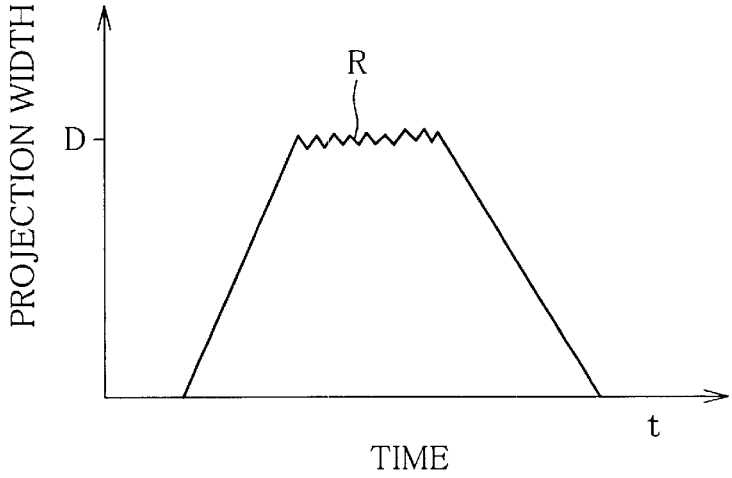
FIG. 6 is a graph showing an output from a photo detector.

When the filter rod F in one pickup groove 8 starts in to enter the illuminated region of the light from the floodlight 26 while the inspection drum 6 rotates, the light to be received from the floodlight 26 into the light receiver 30 is partly shielded by the filter rod F, and the quantity of light received by the light receiver 30 is decreased. Herein, the light receiver 30 sends an output corresponding to the decrement of the quantity of received light to the gate circuit 40, and the output of the light receiver 30 corresponds to the projection width of the filter rod F. Therefore, as shown in FIG. 6, the projection width of the filter rod F increases gradually in accordance with the progress of the filter rod F into the illuminated region of light. Thereafter, the projection width is held at a maximum value or its vicinity while the filter rod F is completely covered or entered within the illuminated region of light. After this, as the filter rod F gradually emerges from the illuminated region of light, the projection width decreases gradually.

Figure 7:
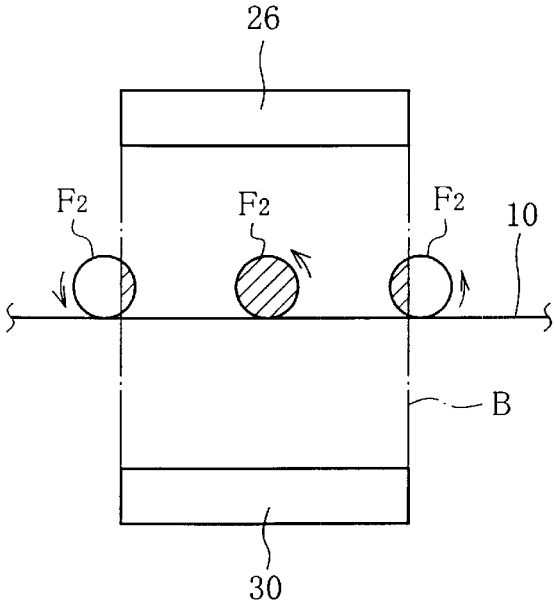
FIG. 7 is a diagram showing the principle of inspection.

Such a change of the projection width will be more clearly understood by referring to FIG. 7. In FIG. 7, the one-dot chain lines indicate the light illuminated region B. Concerning a filter rod $F_1$ in the process of entering into the light illuminated region B and a filter rod $F_2$ in the process of emerging from the light illuminated region B, the projection widths of these filter rods $F_1$ and $F_2$ are shown in the shaded areas in the cross section of the filter rods. Therefore, the light receiver 30 outputs the projection widths corresponding to the shaded areas.

By contrast, while a filter rod $F_3$ is completely covered or entered within the light illuminated region B, the projection width of the filter rod $F_3$ shows the whole of its cross section shown in the shaded area, that is, its diameter. Therefore, the light receiver 30 outputs the maximum value corresponding to the diameter of the filter rod $F_3$, that is, the projection width D.

Figure 8:
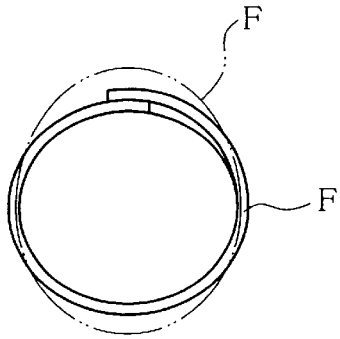
FIG. 8 is an end view of a filter rod.

Herein, the cross section of the filter rod F is not a complete round. Describing this point in detail, since the filter rod F is formed by wrapping the fibrous filter material by paper, its cross section is not a complete round as shown in FIG. 8 owing to its manufacturing process, and is a slightly flat circle. Moreover, both side edges of the paper are overlapped each other to form a seam, and this seam forms a bump on the outer periphery of the filter rod F.

Accordingly, when the filter rod F is completely covered or entered within the light illuminated region B, if the filter rod F is rolling, the cross section of the filter rod F, that is, its projection diameter D changes alternately between the state of solid line and the state of two-dot chain line in FIG. 8. Therefore, the output from the light receiver 30 or projection diameter D is not a constant value, but fluctuates slightly as shown in FIG. 6, according to rolling of the filter rod F. Such a fluctuation is expressed as a ripple R in the portion showing the projection diameter D output from the light receiver 30 as shown in FIG. 6. As a result, by detecting if the projection diameter D from the light receiver 30 has a ripple R or not, it is possible to determine if the filter rod F is rolling, that is, if the filter rod F is normal or defective.

Figure 9:
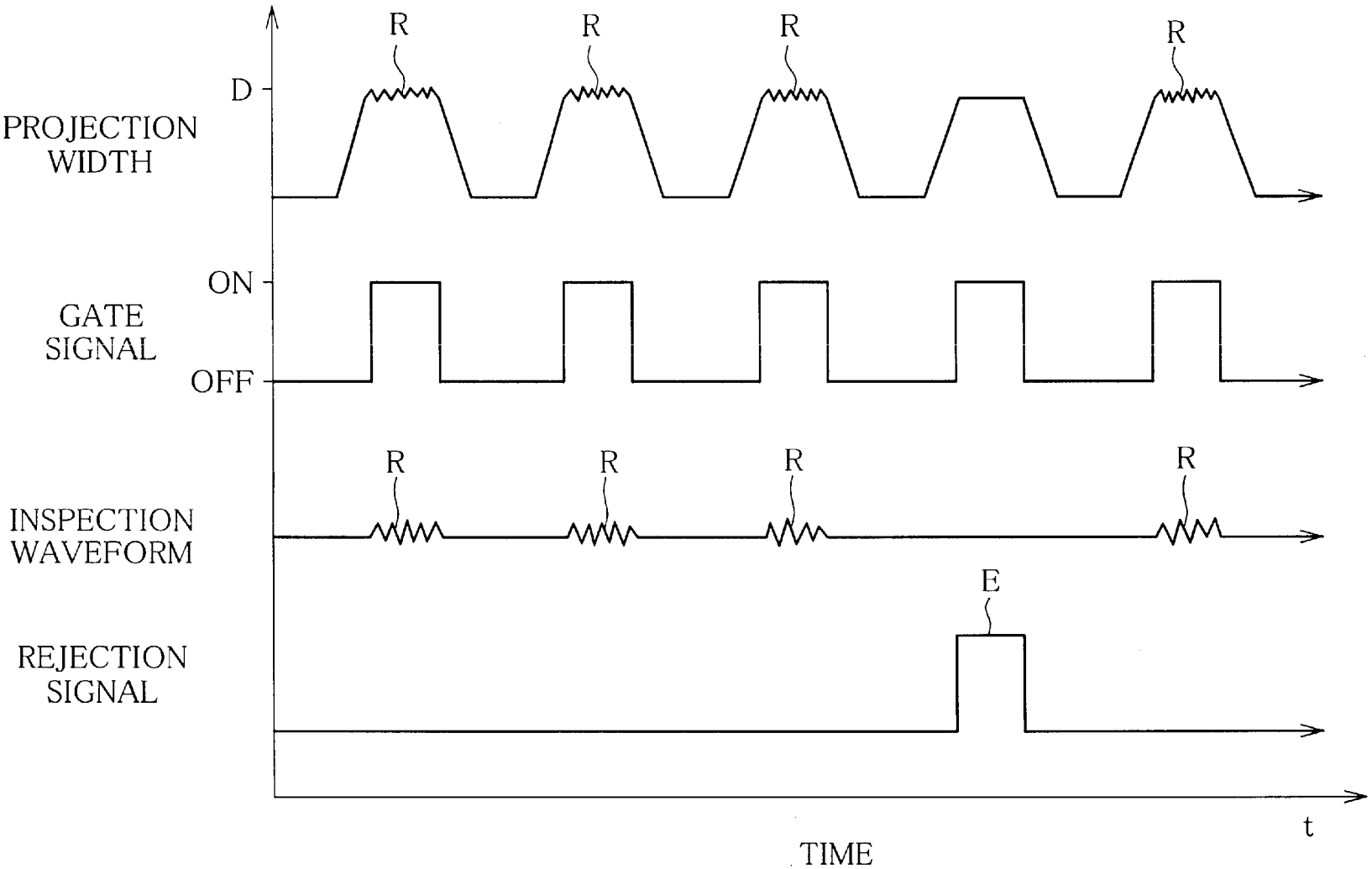
FIG. 9 is a graph showing the function of the detecting/determining circuit.

More specifically, when the filter rods F sequentially pass through the illuminated region of light from the floodlight 26, the output (projection diameter) from the light receiver 30 is produced periodically as shown in FIG. 9. At this time, the gate circuit 40, as mentioned above, supplies the output from the light receiver 30 into the determining circuit 44 while the gate signal is being output. That is, the determining circuit 44 can receive the output from the light receiver 30 only while the filter rod F is completely covered or entered within the illuminated region of light from the light receiver 30.

The determining circuit 44 extracts only the ripple R by offset of the output from the light receiver 30, and amplifies the extracted ripple R, and generates an inspection waveform as shown in FIG. 9. Herein, during the inspection period in which the output of the gate signal continues, the determining circuit 44 determines that the filter rod F is rolling securely and is hence normal if the inspection waveform is a ripple R.

By contrast, during the inspection period, if a ripple R is not produced in the inspection waveform, the determining circuit 44 determines that the filter rod F is not rolling and is hence defective. In this case, as shown in FIG. 9, the determining circuit 44 generates a rejection signal E, and supplies the rejection signal E into the driver circuit 46 (FIG. 5).

Receiving a rejection signal E, the driver circuit 46 opens the solenoid valve of the rejection nozzle 36 at the timing of the defective filter rod F passing through the rejection nozzle 36, and injects compressed air from its nozzle opening for a predetermined period only. As the compressed air is injected, the compressed air is blown against the defective filter rod F in the pickup groove 8 through the light guide hole 32, thereby discharging the defective filter rod F from the pickup groove 8 by overcoming the suction force. Therefore, the defective filter rod F will not be supplied from the inspection drum 6 into the drum 14, and the productivity of the filter-tipped cigarettes can be enhanced.

Beneath the inspection drum 6, a recovery box (not shown) is disposed, and the defective filter rods F rejected from the inspection drum 6 are collected in the recovery box.

The invention is not limited to the foregoing embodiment alone. For example, the drum shell 24 of the inspection drum 6 may be also formed of a transparent material. In this case, the light guide holes 32 of the drum shell 24 may be omitted.

When rejecting defective filter rods, plural rejection nozzles 36 may be also used. In this case, these rejection nozzles 36 are disposed at predetermined intervals in the axial direction of the pickup grooves 8. When plural rejection nozzles 36 are used, the defective filter rods can be securely rejected by injection of the compressed air from these rejection nozzles 36 even if the appearance shape of the filter rod is largely deformed, Further, instead of the floodlight 26 or the light receiver 30, a laser scanner for optically inspecting the outer periphery of the filter rod, or a vision system may be used.

What is claimed is:

1. An inspection device of a filter rod for cigarettes, comprising:

conveying means having a conveying path for feeding the filter rod, and a rolling surface extending along the conveying path, the rolling surface providing the filter rod with rolling force, the conveying path including an illuminated region of light sufficiently wider than a diameter of the filter rod;

detecting means for detecting if the filter rod in the conveying path is rolling on the rolling surface as it passes the illuminated region of light of the conveying path, and outputting the result of detection; and determining means for determining if the filter rod is defective or not on the basis of the result of detection from said detecting means.

2. The inspection device according to claim 1, wherein said conveying means includes:

a rotatable inspection drum having a groove on an outer periphery thereof, the groove receiving one filter rod and allowing the received filter rod to roll therein when the received filter rod is normal; and a rolling guide extending along the outer periphery of said inspection drum and covering the outer periphery partially and having an inner surface as said rolling surface for providing the filter rod with the rolling force due to frictional force when the filter rod in the groove is in contact with the inner surface.

3. The inspection device according to claim 1, wherein said detecting means includes measuring means for optically measuring a diameter of the filter rod while the filter rod passes the illuminated region of light of the conveying path, and outputting the result of measurement continuously, and means for detecting if a ripple is contained in the result of measurement, and outputting the result of detection.

4. The inspection device according to claim 3, wherein said measuring means includes:

a floodlight for emitting light toward the rolling surface and producing said illuminated region of light capable of completely covering the filter rod with respect to the feeding direction of the filter rod; and a light receiver for measuring a shielded portion of the illuminated region due to the filter rod and outputting the measurement signal continuously while the filter rod is completely covered within the illuminated region of light.

5. The inspection device according to claim 4, wherein said determining means includes a determining circuit for determining that the filter rod is normal when a ripple is contained in the measurement signal from the light receiver.

6. The inspection device according to claim 1, wherein said inspection apparatus further comprises rejected means for rejecting a defective filter rod from the conveying path when the defective filter rod is found out by said determining means.

7. An inspection method of a filter rod for cigarettes comprising:

a conveying step for feeding the filter rod along a conveying path, the conveying path including an illuminating region of light sufficiently wider than a diameter of the filter rod;

a rolling step for causing the filter rod to be in contact with a rolling surface and providing the filter rod with rolling force in the conveying step;

a detecting step for detecting if the filter rod is rolling on the rolling surface while the filter rod is being fed along the illuminated region of light of the conveying path, and outputting the result of detection; and a determining step for determining if the filter rod is defective or not on the basis of the result of detection.

8. The inspection method according to claim 7, wherein said detecting step includes a process of optically measuring a diameter of the filter rod and outputting the measurement signal continuously while the filter rod is completely covered within said illuminated region of light, and a process of detecting if a ripple is contained in the measurement signal, and outputting the result of detection.

* * * * *